United States Patent [19]

Dilich

[11] Patent Number: 4,771,505

[45] Date of Patent: Sep. 20, 1988

[54] FORCE DISTRIBUTION BOTTOM GUARD FOR VERTICALLY CLOSING DOOR

[75] Inventor: Michael A. Dilich, Evanston, Ill.

[73] Assignee: Triodyne, Inc., Niles, Ill.

[21] Appl. No.: 122,564

[22] Filed: Nov. 16, 1987

Related U.S. Application Data

[63] Continuation of Ser. No. 909,562, Sep. 22, 1986, abandoned.

[51] Int. Cl.[4] ..... E05F 5/00

[52] U.S. Cl. ..... 16/86 A; 16/82; 16/DIG. 1; 49/488; 160/201

[58] Field of Search ..... 16/82, 86 R, 86 A, DIG. 1; 49/462, 488; 160/40, 201; 296/207

[56] References Cited

U.S. PATENT DOCUMENTS 3,023,804 3/1962 Howell, Sr. ..... 49/488 X 3,227,205 1/1966 Crosswell ..... 160/201 X 3,815,657 6/1974 Malek et al. ..... 160/201 X 4,443,508 4/1984 Mehl ..... 49/462 X

*Primary Examiner*—Fred A. Silverberg

*Attorney, Agent, or Firm*—Lee & Smith

[57] ABSTRACT

A safety device for the bottom of a vertically-closing door, such as a sectional garage door. The device comprises an elongated member installed at the bottom of the door and parallel thereto, the member having a substantially horizontal bottom surface and an upper surface which slopes downwardly and outwardly from the door. The width of the member is sufficient to bridge over the neck of a human if inadvertently trapped beneath the door when closing. The safety device may be formed as part of the bottom of a door when manufactured, or may be a later addition to an existing door.

11 Claims, 1 Drawing Sheet

Fig. 1
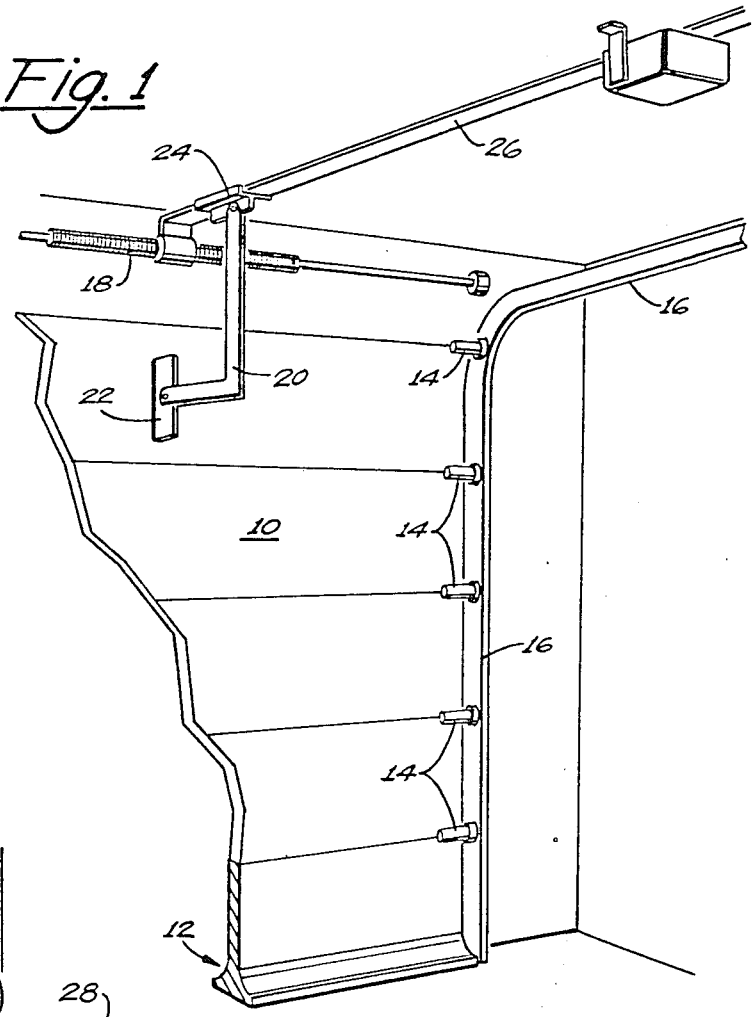
Fig. 2
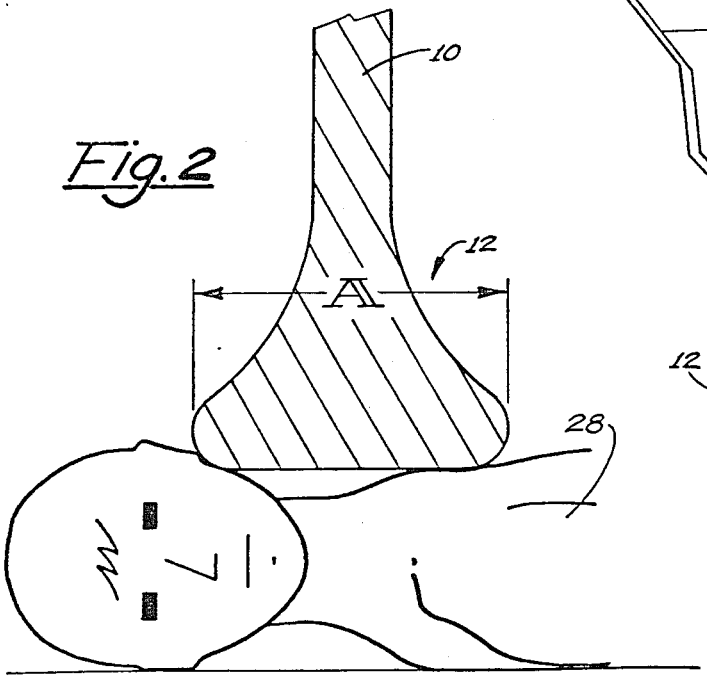
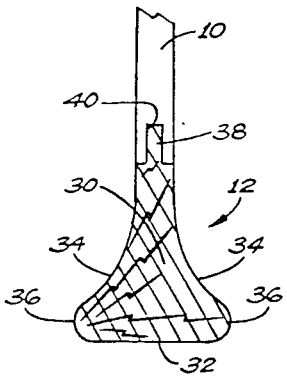
Fig. 3
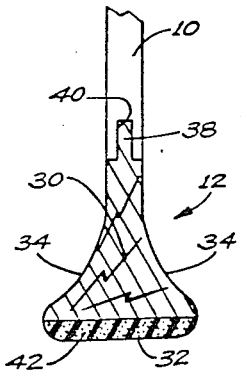
Fig. 4
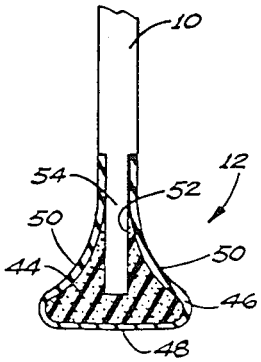
Fig. 5
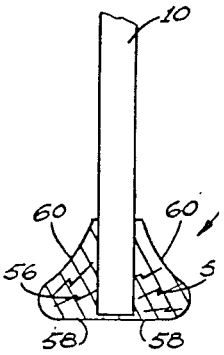
Fig. 6

FORCE DISTRIBUTION BOTTOM GUARD FOR VERTICALLY CLOSING DOOR

This application is a continuation of application Ser. No. 909,562 filed Sept. 22, 1986, now abandoned.

BACKGROUND OF THE INVENTION

This invention pertains to a safety device for a lower portion of a vertically-closing door, such as a sectional garage door, and more particularly to a device which expands the footprint of the door, thereby spreading the downward force of the door if an individual inadvertently becomes trapped beneath the door as it closes.

With the increasing popularity of garage door opening mechanisms, variously known as garage door operators or garage door openers, has come increasing instances of injury or death of individuals trapped beneath the door as it closes. There are many documented cases where individuals, usually young children, have been severely injured or killed by a garage door when controlled by an automatic garage door operator. In the typical situation, the operating mechanism is activated and a child is trapped by the door in its downward progression. If the door is not provided with a reversing mechanism or if the reversing mechanism does not function properly, and if the door closes against the child's chest, the chest is compressed, pinning the child and preventing air flow. If the door closes across the child's neck or if the child struggles until the door is situated across his neck, strangulation or a fractured neck occurs. With door closing forces typically exceeding 100 pounds near the fully closed position, closing of the door elsewhere on the body induces severe injuries, normally broken bones and internal injuries.

As explained in my co-pending U.S. patent application Ser. No. 904,376, filed 09/15/86, and entitled "Safety Mechanism For A Vertical Closure", the emerging hazards of garage doors have lead to many suggested safety features for the doors. In my co-pending patent application, I have disclosed a collapsible segment for the drive train of door operating mechanisms, such as a garage door operator. My safety mechanism is quite accurate and consistant in helping prevent serious injury or death should an individual become trapped beneath the door.

One attendant hazard of an automatically-activated garage door is the downward force exerted by the door as it closes. If all safety devices, such as automatic roll back features, timing mechanisms and release devices, become inoperative for one reason or another, as explained above, as the door nears its fully closed position, door closing forces can exceed 100 pounds. Because the width of the door is quite narrow, normally $1\frac{1}{2}$ to $2\frac{1}{2}$ inches, the force is exerted across a relatively small area, and if the door impinges against the neck of a trapped individual, the door can easily compress the neck with resulting injury or death.

SUMMARY OF THE INVENTION

The present invention is directed to a safety device for the lower portion of a vertically-closing door, such as a garage door, which creates a larger footprint than the normal door, thus not only decreasing the force per unit area of the door as it closes, but also providing an opportunity for the door to bridge over crucial body parts, such as the neck, of an individual who becomes trapped. The safety device comprises an elongated member at the lower marginal edge of the door which is disposed parallel to the bottom of the door. The member has a horizontal bottom surface and an upper surface sloping downwardly and outwardly from the door, and having a width sufficient to at least bridge a human neck. In bridging over a human neck, the width is sufficient to extend from the base of the human skull or jaw to the upper most skeletal area of the chest. For a child, a width in the range of 6 to 8 inches maximum is quite adequate for sufficient bridging of the neck and spreading of the force footprint of the door.

The safety device can be formed as an integral part of a door, or as a later-added adjunct. If the latter is the situation, the member can comprise either a single segment attached to one side of the door, or a pair of segments located at opposite sides of the lower marginal edge of the door. The segments may be identical, or one may be larger than the other if clearance on one side of the door is of particular concern. For added safety, the upper surface joins the bottom surface at a rounded edge which extends the full length of the elongated member.

A compressible pad may be secured to the bottom surface of the door extending the length and width thereof. The compressible pad permits the safety device to comply with an entrapped victim's body, thereby reducing load concentrations.

The upper surface of the elongated member is sloped so that an individual, again typically a child, may not stand on the safety device as the door is raised or lowered. A slope exceeding 45 degrees with respect to the horizontal bottom surface is adequate to deter such an activity.

The safety device can also be a unitary structure which is manufactured to form the lower portion of the bottom panel of the door. In such instances, for attachment of the safety device a to wooden door, a longitudinal tongue can be formed in the top of the elongated member and a corresponding groove can be formed in the bottom of the door. Alternatively, a longitudinal groove can be formed in the elongated member, the groove having a width sufficient to accomodate the bottom of the door. If desired, the bottom of the door can be shaped to include a tongue which fits within the longitudinal groove in the elongated member. For doors constructed from aluminum or steel, the safety device could be formed as an integral part of the lower door panel.

The elongated member can be formed of a rigid material, such as wood, plastic, or metal, the latter two being manufactured in an extruded fashion, or it can be formed of a resilient material, such as a semi-rigid plastic foam. However formed, the bottom of the member may be provided with a compressible pad to enhance the chances that the bottom surface of the elongated member complies to the contours of an individual's body, reducing the load concentration.

The safety device of the invention permits normal weatherstripping of the bottom of the door. Weatherstripping can be added to the device or can be incorporated in the basic configuration of the safety device when manufactured.

BRIEF DESCRIPTION OF THE DRAWING FIGURES

The invention is described in greater detail in the following description of examples embodying the best mode of the invention, taken in conjunction with the drawing figures, in which:

FIG. 1 is a partial perspective view of a sectional garage door including the safety device of the invention at the bottom thereof, FIG. 2 is an enlarged cross-sectional illustration of the safety device according to the invention illustrating the manner in which the device will bridge the human neck from the base of the skull to the upper most skeletal area of the chest, FIG. 3 is a cross-sectional illustration of one form of the invention, FIG. 4 is a cross-sectional illustration of a second form of the invention, FIG. 5 is a cross-sectional illustration of a third form of the invention, and FIG. 6 is a cross-sectional illustration of a fourth form of the invention.

DESCRIPTION OF EXAMPLES EMBODYING THE BEST MODE OF THE INVENTION

Several embodiments of the invention are shown in the drawing figures addressing employment of the invention in conjunction with the bottom of an existing door, both incorporation of the device into a newly-manufactured door or as a retro-fitting of an existing door. While several forms of the invention are illustrated and described, it should be quite evident that many other forms and materials may be employed, as needs or desires dictate.

Illustrated in FIG. 1 is a garage door 10 having the safety device 12 of the invention installed at the lower portion thereof. The garage door 10 is a typical sectional door which has a series of wheels 14 at opposite ends of the panels of the door and which travel in a track 16 extending vertically at the garage door opening and horizontally above the floor of the garage. To balance the weight of the garage door 10, a spring 18 and associate linkage is connected to the garage door 10 in a conventional fashion. The door 10 is illustrated connected to a garage door operator. The operator includes an actuator arm 20 pivotally secured to a bracket 22 attached to the uppermost panel of the garage door 10. The actuator arm 20 is also pivotally secured to a traveler 24 which is translated in a track 26 secured to the ceiling of the garage. The traveler 24 can be driven by a screw mechanism, chain mechanism, or any other type of conventional mechanism as may be desired. That mechanism, in turn, is driven by an appropriate motor (also not illustrated) so that, when the traveler 24 is driven to and fro, the door 10 is either raised or lowered. The garage door 10 and the garage door operator (composed of the actuator arm 20, traveler 24, track 26 and associate driving mechanism) may be commonly-known devices.

The safety device 12 is illustrated in FIG. 2 in contact with a victim 28 who has become trapped beneath the garage door 10. As illustrated, safety device 12 has a width "A" which, as shown, bridges over the victim's neck, extending from the base of the victim's skull or jaw to the upper most skeletal area of the victim's chest. Since, as explained above, almost all instances of individuals being trapped beneath a garage door have involved children, a maximum width "A" of 6 to 8 inches is normally very adequate to achieve the purposes of the invention.

Varying forms of the invention are shown in FIGS. 3 through 6. Turning first to FIG. 3, the safety device 12 is composed of a unitary elongated member 30 at the lower marginal edge of the door 10, which is disposed parallel to the bottom of the door 10, and which is intended to extend the width of the door 10. The elongated member 30 has a horizontal bottom surface 32 and opposite upper surfaces 34 which slope downwardly and outwardly from the door 10. The bottom surface 32 and the upper surfaces 34 each join at a rounded edge 36 also extending length of the elongated member 30.

The elongated member 30 is attached to the bottom of the garage door 10 in a tongue-and-groove fashion. A longitudinal tongue 38 is formed at the top of the elongated member 30, and a corresponding groove 40 is formed in the bottom of the door 10. An adhesive of any nature can be used to secure the elongated member 30 to the garage door 10 or other means of attachment, such as screw fasteners, can be employed as needs dictate.

The embodiment of FIG. 4 of the invention is essentially the same as the embodiment of FIG. 3, and like elements bear identical reference numerals. In FIG. 4, the elongated member 30 also includes a compressible pad 42 which extends the length and width of the elongated member 30. The pad 42 permits the safety device 12 to at least partially conform to the contours of the body of the victim 28, thus producing somewhat reducing load concentrations.

The elongated member 30 illustrated in FIGS. 3 and 4 may be composed of wood, as shown, which is hollow or solid. Alternatively, the elongated member 30 can be made of a compressed particle material, extruded plastic, or extruded metal, such as aluminum. Futhermore, although the upper surfaces 34 are shown with a radiused slope, the slope can be contoured otherwise or can be generally straight. The slope should exceed 45 degrees in order that an individual may not use the safety device 12 as a means to ride upwardly and downwardly with the the door 10 when it is driven.

FIG. 5 illustrates another form of the invention. The safety device 12 is composed of an elongated member having a resilient inner portion 44 and a semi-flexible skin 46. In a fashion identical to FIGS. 3 and 4, the safety device 12 has a horizontal bottom surface 48 and upper surfaces 50 which slope downwardly and outwardly from the garage door 10. The resilient portion 44 may be composed of semi-rigid foam, while the skin 46 can be a suitable plastic.

For installation on the lower portion of the door 10, the safety device 12 of FIG. 5 includes a longitudinal groove 52 which extends the length of the safety device 12, and which is dimensioned adequately to accomodate a downwardly depending tongue 54 formed at the bottom of the garage door 10. Similar to the embodiments of FIGS. 3 and 4, the safety device 12 can be affixed to the garage door 10 by suitable adhesives or fasteners.

Yet another form of the invention is illustrated in FIG. 6. In this embodiment, the safety device 12 is composed of a pair of elongated segments 56 disposed on opposite sides of the lower marginal edge of the garage door 10. Similar to the earlier forms of the invention, each of the segments 56 includes a horizontal bottom surface 58 and an upper surface 60 which slopes downwardly and outwardly from the door 10. The bottom surfaces 58 are coextensive with the bottom of the garage door 10 and the aggregate width of the segments 56 and the garage door 10 is that of the prior embodiments of the safety device 12 of FIGS. 3 through 5. In this embodiment of the invention, the segments 56 can also be secured to the garage door 10 by any conventional means, such as by adhesives and fasteners.

On occasion, because of limited clearances of the garage door 10 in relation to its adjacent building structure, it may not be feasible to have segments 56 of equal dimensions. If necessary, a single segment 56 can be employed on one side of the door 10, with the aggregate width of the segment 56 and the door 10 remaining sufficient to accomplish the necessary bridging required of the safety device 12. Alternatively, one of the segments 56 can be larger than the other so that the bottom surface 58 of one is larger than the other but with the aggregate width of the segments 56 and the garage door 10 remaining the same. Other variations will be apparent as needs dictate.

The various bottoms of the safety device 12 of the embodiments of FIGS. 3 through 6 can accomodate conventional weatherstripping (not illustrated) for the door 10. The weather stripping can either be attached to the bottom of the safety device 12, or can be incorporated within the structure of the safety device 12 when manufactured. With particular reference to FIGS. 4 and 5, because a compressible pad 42 or resilient inner portion 44 has been incorporated in the safety device 12, weatherstripping may be unnecessary if the floor against which the garage door 10 closes is reasonable smooth and level.

ACHIEVEMENTS

The invention provides a safety device which prevents the bottom edge of a garage door from pressing directly on the neck of an entapped victim. It bridges over the neck by pressing on the base of the skull or jaw and the shoulder area, thus substantially reducing the likelihood of strangulation. Futhermore, if the door 10 should close elsewhere on a victim's body, the safety device reduces the contact pressure acting on an entrapped person's body, and particularly if pressing against the chest, reduces chest compression and improves the victim's capacity to continue breathing.

The sloping upper surfaces 34, 50 or 60 of the safety device 12 prevent an individual from inadvertently or advertently using the safety device 12 as a platform upon which to stand and potentially fall as the door 10 is raised.

When the safety device 12 employs a compressible pad 42 or is of a semi-flexible construction such as that shown in FIG. 5, the bottom surfaces of the safety device 12 will comply with an entrapped victim's body, thereby further reducing load concentrations. Rounded corners on any form of the invention eliminate sharp bearing areas, also reducing potential injury.

Because of its size, the safety device 12 will be conspicuous at the bottom of a garage door 10. That conspicuity will enhance a person's awareness of potential hazards of the door 10.

Various changes can be made to the invention without departing from the spirit thereof or scope of the following claims.

I claim:

1. In combination with a garage door, a substantially solid safety system for the lower portion of the door for increasing the width of the door at its bottom to give the door a widened area upon which the door bears a downward load, comprising an elongated member mounted on the lower marginal edge of the door, said member having a horizontal bottom surface in registration with the lower edge of the door with the bottom surfaces and the lower edge of the door being substantially flat and remaining flat for all travel of the door, said member further having an upper surface as a continuous extension of the door which only slopes downwardly and outwardly from the door, and said member being rigid such that any downwardly-directed force exerted by the door is dispersed across the increased width of the bottom of the door, the combination of said member and said door fully supporting the downward load of the door at any point across the bottom surfaces of the member including outward edges thereof, the safety system having an aggregate width comprising the width of said member in combination with the width of the door and rigidity sufficient to bridge over a human neck.

2. A safety device according to claim 1 in which said member comprises a pair of segments located at opposite sides of the lower marginal edge of the door.

3. A safety device according to claim 2 in which said segments are identical.

4. A safety device according to claim 1 in which said bottom surface and said upper surface join at a rounded edge extending the length of said member.

5. A safety device according to claim 1 including a compressible pad secured to said bottom surface and extending the length and width of said bottom surface.

6. A safety device according to claim 1 in which the width of the member is at least six inches.

7. A safety device according to claim 1 in which the slope of said upper surface is at least 45 degrees with respect to said bottom surface.

8. A safety device according to claim 1, including means for attaching the safety device to the door comprising a longitudinal tongue formed in the top of said elongated member and a corresponding groove formed in the bottom of the door.

9. A safety device according to claim 1, including means for attaching the safety device to the door comprising a longitudinal groove formed in said elongated member and having a width sufficient to accomodate the bottom of the door.

10. A safety device according to claim 9 in which the bottom of the door includes a tongue shaped to fit within said groove.

11. A safety device according to claim 9 in which said member is composed of a resilient material.

* * * * *